US007347584B2

(12) United States Patent
Sun et al.

(10) Patent No.: US 7,347,584 B2
(45) Date of Patent: Mar. 25, 2008

(54) LIGHT EMITTING DIODE LAMP ASSEMBLY

(75) Inventors: Tsung-Ting Sun, Taipei Hsien (TW); Hung-Ta Liao, Taipei Hsien (TW); Tzu-Hsuan Yen, Taipei Hsien (TW); Pao-Shen Chen, Taipei Hsien (TW)

(73) Assignee: Edison Opto Corporation, Chung-Ho, Taipei Hsien (TW)

( * ) Notice: Subject to any disclaimer, the term of this patent is extended or adjusted under 35 U.S.C. 154(b) by 0 days.

(21) Appl. No.: 11/634,295

(22) Filed: Dec. 6, 2006

(65) Prior Publication Data

US 2008/0013318 A1 Jan. 17, 2008

(30) Foreign Application Priority Data

Jul. 14, 2006 (TW) ..... 95212442 U

(51) Int. Cl.
*F21V 29/00* (2006.01)

(52) U.S. Cl. ..... 362/218; 362/294; 362/241

(58) Field of Classification Search ..... 362/96, 362/217, 218, 237, 240, 241, 243, 294, 297, 362/346, 373, 547, 800
See application file for complete search history.

(56) References Cited

U.S. PATENT DOCUMENTS 4,607,623 A * 8/1986 Bauman ..... 362/217
6,220,722 B1 * 4/2001 Begemann ..... 362/294
6,991,351 B1 * 1/2006 Petrick ..... 362/373
7,207,695 B2 * 4/2007 Coushaine et al. ..... 362/240
2005/0168985 A1 * 8/2005 Chen ..... 362/241

* cited by examiner

*Primary Examiner*—Y. My Quach-Lee
(74) *Attorney, Agent, or Firm*—Birch, Stewart, Kolasch & Birch, LLP

(57) ABSTRACT

A Light Emitting Diode (LED) lamp assembly comprises a base, a plurality of linear-extended LED lighting sources, a reflecting and heat-dissipating module, and a thermal module. The linear-extended LED lighting sources are distributed and connected to the base for optionally projecting at least one projecting light and releasing light heat simultaneously. The reflecting and heat-dissipating module is provided with a central heat-dissipating region approximately located on a central region of all the LED lighting sources and a plurality of reflecting and heat-dissipating members radially extended from the central heat-dissipating region for separating the linear-extended LED light sources, reflecting the projecting light, absorbing and conducting the light heat. The thermal module is arranged within the central heat-dissipating region for dissipating the light heat absorbed and conducted by the reflecting and heat-dissipating members.

14 Claims, 3 Drawing Sheets

LIGHT EMITTING DIODE LAMP ASSEMBLY

FIELD OF THE INVENTION

The present invention relates to a light emitting diode (LED) lamp assembly, and more particularly to a LED lamp assembly used a plurality of linear-extended LED lighting sources for projecting lights and a thermal module for heat dissipating.

BACKGROUND OF THE INVENTION

LED is an electronic element, which can radiate light when applying electric power. The lighting principle of LED is translating electric power to light energy, that is, doping a minute amount of carriers into a conjunction of P-type side and N-type side and continuously combining the minute amount of carriers with a major amount of carriers to form a LED. To be with the good performance of the LED radiation may need a large amount of pairs of electrons and holes, the space charge layers become narrower when applying a forward biased voltage, and then a major amount of carriers are doped into the P-type side and the N-type side according to Fermi characteristic energy level deviation. Due to that the minute amount of carriers are increased on the P-type side and N-type side, the pairs of electrons and holes located on the P-type side and the N-type side are recombined to release sufficient photons. In the present, the categories of LED generally include GaAa, GaAs1-xPx, and GaP series, etc. Additionally, adding nitrogen atoms to the GaAa, GaAs1-xPx, and GaP series LED also can change the lighting color of these series of LED.

Since the LED has the advantages of lightweight, less volume, low power consumption, and long working life, etc., it is gradually used to replace the conventional light bulbs for wide applications and to approach the aspect of environmental protection. However, the light strength of the LED is controlled by stimulating voltage and has an obvious characteristic of emitting directionality, so the illumination of the light projected from the LED is not uniform enough to be applied as a lighting source of a wide-angle lighting apparatus. Accordingly, in order to provide uniform illumination, a preferred application in prior arts is a fluorescent light served without the characteristic of emitting directionality, as a main lighting source of the lamp assembly. These lamp assemblies are usually fitted with one or more fluorescent lights and controlled by single-shift or multi-shift switches, wherein a triple-shift lamp assembly is the representation of all.

Please refer to FIG. 1, which is a partially-exploded view illustrating a structure of a triple-shift fluorescent lamp assembly provided in accordance with prior arts. As shown in FIG. 1, a triple-shift fluorescent lamp assembly 1 provided in accordance with prior arts includes a base 11, three fluorescent lights 12, a reflector 13, and a lampshade 14.

Two ends of the fluorescent lights 12 are fitted on the base 11 as a shape of "reversed U". The reflector 13 is provided with a sectional shape of "Y" for separating the fluorescent lights 12 and the lights projected from the fluorescent lights 12. The lampshade 14 is composed of a transparent material and covers the fluorescent lights 12 and the reflector 13.

In practice, the triple-shift fluorescent lamp assembly 1 is usually provided with three starters or one or two mutual-operating starters, and a multi-shift switch, so that the triple-shift fluorescent lamp assembly 1 can optionally trigger one, two or three of the fluorescent lights 12.

However, anybody may ask why the fluorescent lights 12 should be provided in the shape of "reversed U", and it occupies a larger space and generates more heat. People skilled in relative arts will easily realize that both the two ends of the fluorescent lights 12 must be fitted to the base 11 and connected to pre-arranged circuits, electrons can impact particles, especially the particles of mercury vapor, within the fluorescent lights 12 for generating ultraviolet rays to stimulate fluorescent powder projecting white lights. Thus, the fluorescent lights 12 should be designed in a requirement of extending from one end thereof fitted on the base 11 to the other end also fitted on the base 11. For all possible extending shapes meeting the requirement, the shape of "reversed U" has the shortest extending length and is widely applied by most people skilled in this art. Comparing with the fluorescent lights 12, LED just provides a high-voltage pin and a low-voltage pin on one end thereof and may not need the shape of "reversed U" at all.

While, the electric power consumption of the LED is just one eighth of the incandescent light, and the working life of the LED is fifty to one hundred times of the incandescent light

SUMMARY OF THE INVENTION

The problems intended being solved in the present invention and the objectives of the present invention:

To make a summary, since the LED has the advantages of less space-occupied, lower electric power consumption, longer working life, and lower lighting temperature with respect to the fluorescent lamp. Therefore the problem of the illumination being not uniform enough has been overcome, the LED will have more commercial values to replace the fluorescent light and be applied in multi-shift light apparatuses.

Thus, the primary objective of the present invention is providing a LED lamp assembly, which uses a plurality of linear-extended LED lighting sources for projecting lights, and the LED lighting sources work with a reflecting and heat-dissipating module for modulating projecting lights with larger lighting region and uniform illumination. Hence, the LED lamp assembly replaces the fluorescent lamp by the advantages mentioned above.

The second objective of the present invention is providing a LED lamp assembly with a reflecting and heat-dissipating module, and a thermal module. Except for reflecting lights, the reflecting and heat-dissipating module also can work with the thermal module for dissipating heat from the projecting lights, out of the LED lamp assembly.

Means of the Present Invention for Solving Problems

The LED lamp assembly provided by the present invention comprises a base, a plurality of linear-extended LED light sources, a reflecting and heat-dissipating module, and a thermal module. Each linear-extended LED lighting source is distributed and connected to the base, the LED light sources is capable of optionally projecting at least one projecting light and releases light heat. The reflecting and heat-dissipating module comprises a central heat-dissipating region located a central region of all linear-extended LED lighting sources.

The reflecting and heat-dissipating module further comprises a plurality of reflecting and heat-dissipating members for separating the linear-extended LED lighting sources to reflect the projecting lights, and absorbing and conducting the light heat. The thermal module is arranged within the central heat-dissipating region for dissipating the light heat absorbed and conducted by the reflecting and heat-dissipating members.

Additionally, for a preferred embodiment of the present invention, each reflecting and heat-dissipating member is provided with a plurality of thermal fins for rising the efficiency of heat absorbing and dissipating.

Effects of the Present Invention with Respect to Prior Arts

Comparing with the fluorescent light and the incandescent light provided with uniform illumination, the electric power consumption of LED is just one eighth of the incandescent light and half of the fluorescent light, furthermore, the working life of the LED is fifty to one hundred times of the incandescent light and ten times of the fluorescent light. Thus, the means provided in the present invention not only can provide uniform illumination, but also can get the efficiencies of decreasing the electric power consumption of light assembly, improving safety of use, and rising working life.

Comparing with the LED(s) provided in point lighting source type or matrix lighting source type, the linear-extended LED lighting sources can provide better efficiencies of projecting uniform illumination and heat-dissipating under the less space-occupied.

Further scope of the applicability of the present invention will become apparent from the detailed description given hereinafter. However, it should be understood that the detailed description and Specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the following detailed description and the accompanying drawings, which are given by way of illustration only and thus are not limitative of the present invention, and wherein.

DETAILED DESCRIPTION OF THE PREFERRED EMBODIMENTS

Since the linear-extended lighting emitting diode (LED) can be widely applied to many kinds of lamp assembly, the combined applications are too numerous to be enumerated and described, therefore a preferred embodiment of the present invention applied for a triple-shift LED lamp assembly herein is disclosed, and the LED lamp assembly, is replaced by a triple-shift LED lamp assembly described as follows.

Figure 1:
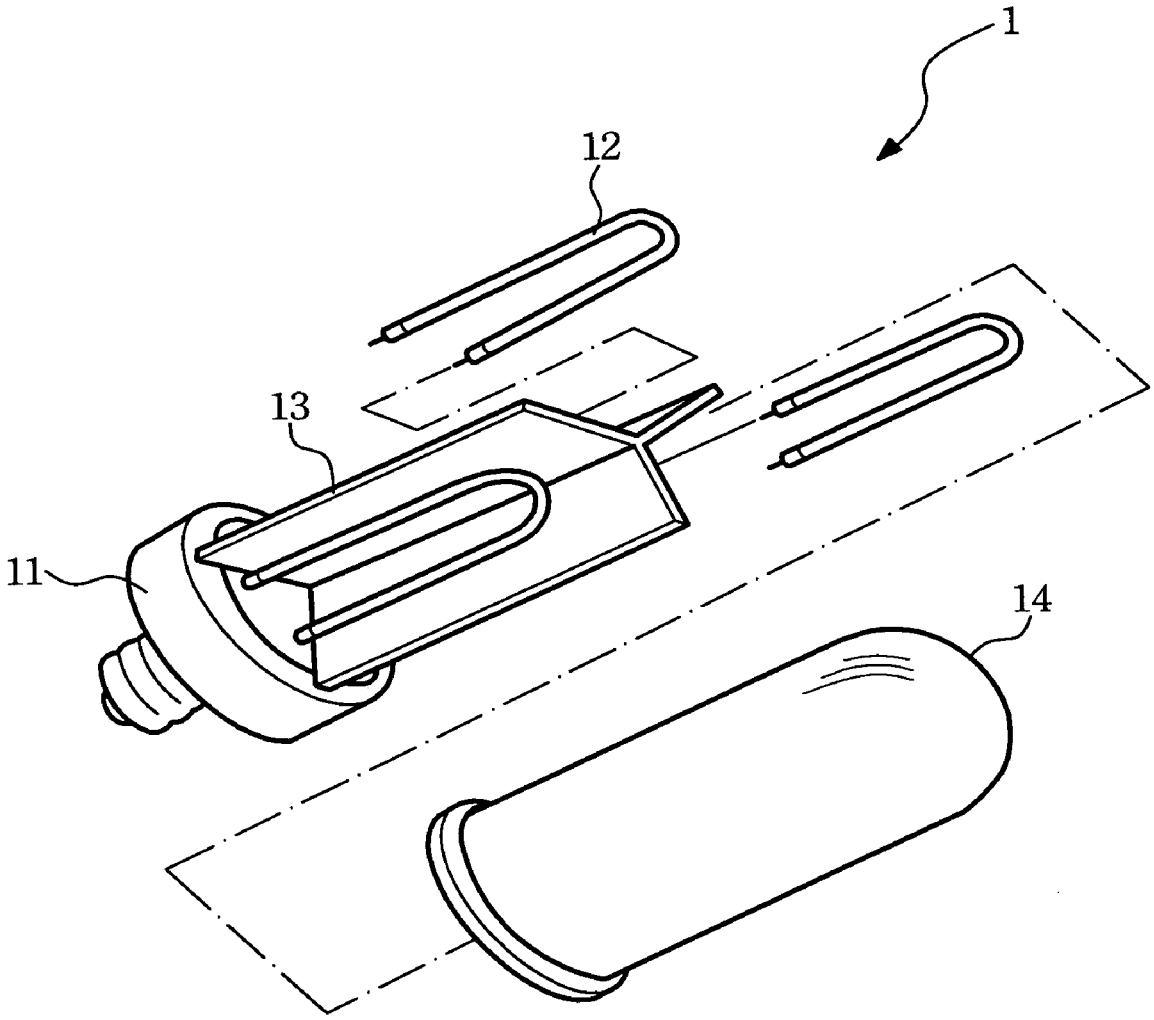
FIG. 1 (Prior Art)
FIG. 1 is a partially-exploded view illustrating a structure of a triple-shift fluorescent lamp assembly provided in accordance with prior arts.
Figure 2:
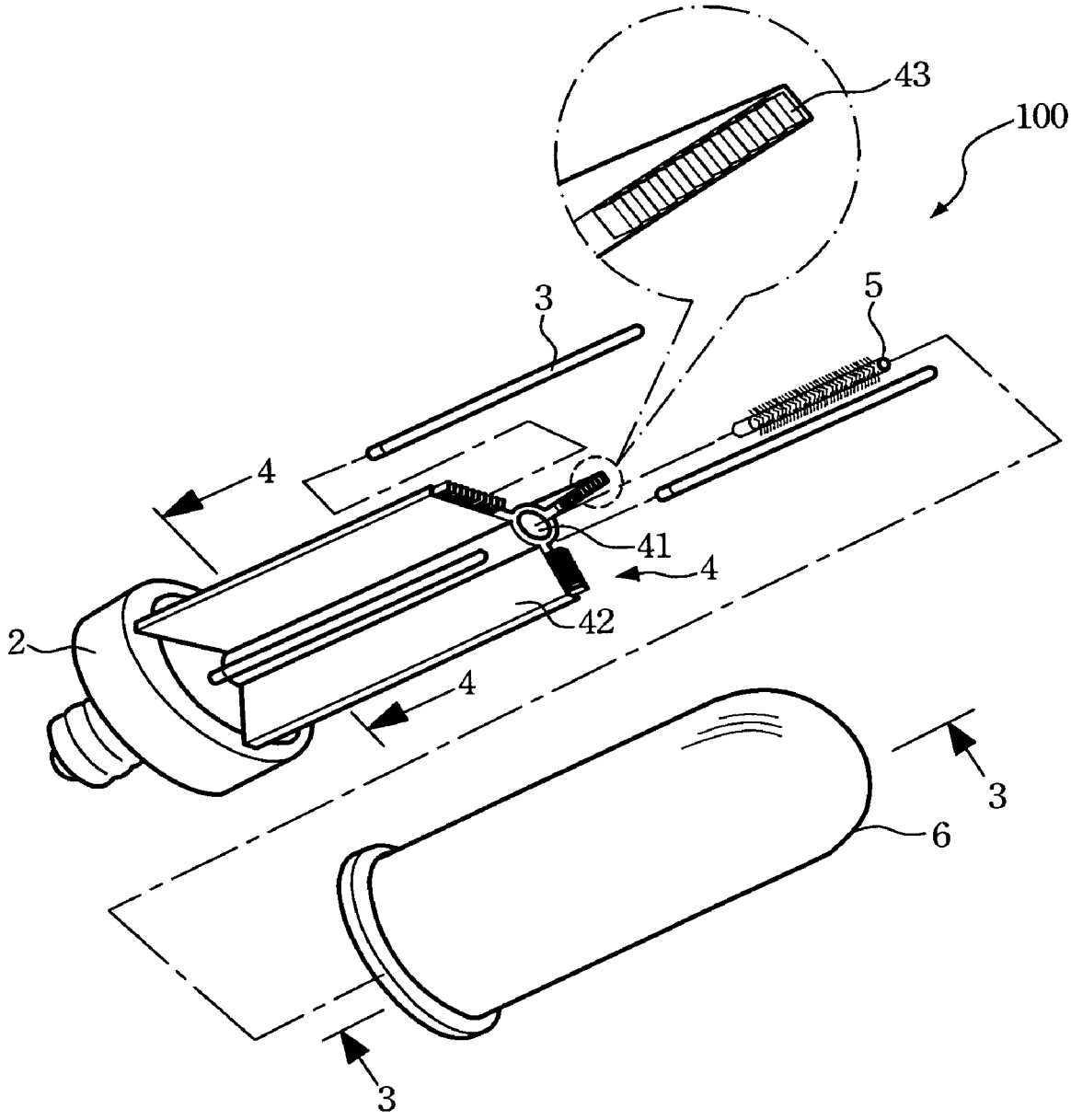
FIG. 2 is a partially-exploded view illustrating the structure of a triple-shift LED assembly provided in accordance with a preferred embodiment of the present invention.
Figure 3:
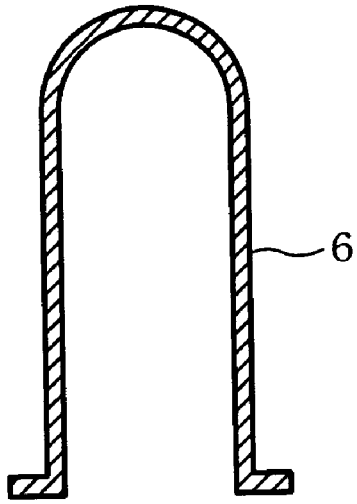
FIG. 3 is a section view illustrating a 3-3 section view of FIG. 2.
Figure 4:
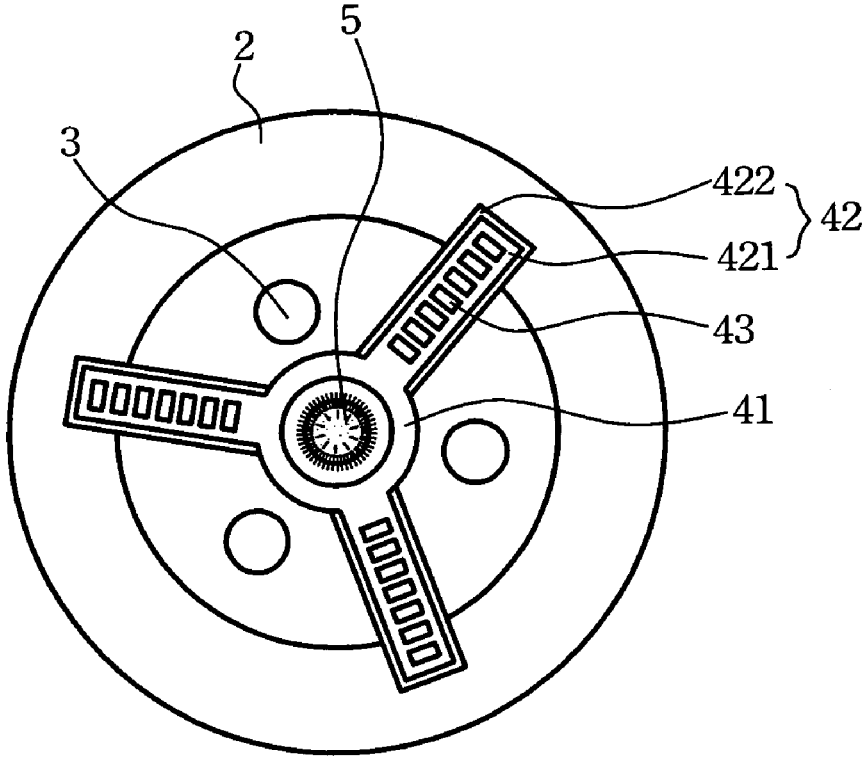
FIG. 4 is a top view illustrating the LED lamp assembly in accordance with the preferred embodiment of the present invention after a lampshade is removed from the rest parts of the LED lamp assembly.

Please refer to FIG. 2 to FIG. 4, wherein FIG. 2 is a partially-exploded view illustrating a structure of a triple-shift LED assembly provided in accordance with a preferred embodiment of the present invention, FIG. 3 is a section view illustrating a 3-3 section view of FIG. 2, FIG. 4 is a top view illustrating the LED lamp assembly in accordance with the preferred embodiment of the present invention after a lampshade is removed. As shown in the figures, a triple-shift LED lamp assembly 100 includes a base 2, three linear-extended LED lighting sources 3, a reflecting and heat-dissipating module 4, a thermal module 5, and a lampshade 6.

A bottom of the base 2 is connected to a lamp holder, and a top of the base 2 is connected with the linear-extended LED lighting sources 3. The triple-shift LED lamp assembly 100 is usually provided with three starters, or one or two mutual-operated starters, which is a prior art and not shown in the figures. Therefore, it can be optionally switched under the situations of one, two, or three of linear-extended LED lighting sources lighted on or off, thereafter to project at least one projecting light and release light heat simultaneously.

The reflecting and heat-dissipating module includes a central heat-dissipating region 41 and three reflecting and heat-dissipating members 42, wherein the central heat-dissipating region 41 is in the form of a tube structure, and located on a central region of all the linear-extended LED lighting sources 3. All the reflecting and heat-dissipating members 42 are radially extended out form the central heat-dissipating region 41, and formed in a sectional shape of "Y" for separating the linear-extended LED lighting sources 3, reflecting projecting lights projected form the linear-extended lighting sources 3, and absorbing and conducting the light heat generated from the projecting lights.

Each of the reflecting and heat-dissipating members 42 includes a substrate plate 421 and a reflecting layer 422 covering the substrate plate 421, wherein the substrate 421 and the tube structure of the central heat-dissipating region 41 are integrated as a member, and composed of a high heat-conductivity material. The reflecting layer 422 is composed of a metal-coating layer and formed as a smooth surface, so that it can uniformly reflect the projecting lights projected from all the linear-extended lighting sources 3 to provide wide-angle and uniform illumination. Meanwhile, the top of the reflecting and heat-dissipating members 42 can be mounted with a top thermal module. For a preferred embodiment of the present invention, the top thermal module is defined as a plurality of fins 43 as shown in the magnified illustrating region of FIG. 2.

The thermal module 5 is disposed within the tube structure of the central heat-dissipating region 41 and thermally connected with the reflecting and heat-dissipating module 4 to dissipating the light heat absorbed and the conducted by the reflecting and heat-dissipating members 42. The lampshade is used for covering the linear-extended LED lighting sources 3, the reflecting and heat-dissipating module 4, and the thermal module 5 so as to reach the effects of dirt-proof and light-modulating.

People skilled in the related arts can easily realize that the high heat-conductivity material usually can be selected from aluminum alloy and copper alloy in practice. Meanwhile, the metal-coating layer usually can be selected from nickel-coating layer and silver-coating layer, which has the characteristics of smooth surface and high heat-conduction.

Furthermore, comparing with the LED(s) provided in point lighting source type or matrix lighting source type, the linear-extended LED lighting sources of the LED lamp assembly, as provided in the preferred embodiment of the present invention, have more advantages of rising lighting area and projecting lights with uniform illumination.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A light emitting diode (LED) lamp assembly comprising:

a base;

a plurality of linear-extended LED lighting sources distributed and connected to the base, being capable of projecting at least one projecting light, and releasing light heat;

a reflecting and heal-dissipating module comprising:

a central heat-dissipating region connected to the base, and located in a central region of all the linear-extended LED lighting sources; and a plurality of reflecting and heat-dissipating members radially extended from the central heat-dissipating region for separating the LED lighting sources, reflecting the projecting light, absorbing and conducting lighting heat; and a thermal module arranged within the central heat-dissipating region for dissipating the light heat absorbed and conducted by the reflecting and heat-dissipating members.

2. The LED lamp assembly as claimed in claim 1, further comprising a top thermal module mounted on a top of each reflecting heat-dissipating member.

3. The LED lamp assembly as claimed in claim 2, wherein the top thermal module is defined as a plurality of thermal fins.

4. The LED lamp assembly as claimed in claim 1 further comprising a lampshade for covering the LED lighting sources, the reflecting and heat-dissipating module, and the thermal module.

5. The LED lamp assembly as claimed in claim 1, wherein the reflecting and heat-dissipating member comprises a substrate plate and a reflecting layer covering the substrate plate.

6. The LED lamp assembly as claimed in claim 5, wherein the reflecting layer is composed of a metal-coating layer.

7. The LED lamp assembly as claimed in claim 6, wherein the metal-coating layer is a nickel-coating layer.

8. The LED lamp assembly as claimed in claim 6, wherein the metal-coating layer is a silver-coating layer.

9. The LED lamp assembly as claimed in claim 5, wherein the central heat-dissipating region is in a form of a tube structure.

10. The LED lamp assembly as claimed in claim 9, wherein the substrate plate of the reflecting and heat-dissipating member and the tube structure are integrated as a member.

11. The LED lamp assembly as claimed in claim 10, wherein the member of the substrate plate of the reflecting and heat-dissipating member and the tube structure is made of high heat-conductivity material.

12. The LED lamp assembly as claimed in claim 11, wherein the high heat-conductivity material is aluminum alloy.

13. The LED lamp assembly as claimed in claim 11, wherein the high heat-conductivity material is copper alloy.

14. The LED lamp assembly as claimed in claim 1, wherein at least one of the linear-extended LED lighting sources is disposed between two neighbor reflecting and heat-dissipating members.

* * * * *